US005220128A

United States Patent [19]

Grau et al.

[11] Patent Number: 5,220,128

[45] Date of Patent: Jun. 15, 1993

[54] SOFT-RECOVERY SYSTEM FOR GUN-LAUNCHED PROJECTILES

[76] Inventors: John C. Grau, 55 Colleen Dr., Sussex, N.J. 07461; Gregory Malejko, 5 Peter Dr., R.D. 3, Hackettstown, N.J. 07840; John DiPalma, 4041 E. Western Star Blvd., Phoenix, Ariz. 85044

[21] Appl. No.: 796,505

[22] Filed: Nov. 22, 1991

[51] Int. Cl.[5] ..... F42B 10/04; F42B 10/06

[52] U.S. Cl. ..... 102/293; 102/342; 102/357; 102/473

[58] Field of Search ..... 102/293, 340, 342, 351, 102/357, 393, 473, 489, 395, 498

[56] References Cited

U.S. PATENT DOCUMENTS

| | | | |
|---|---|---|---|
| 3,013,493 | 12/1961 | Fletcher | 102/340 |
| 3,351,013 | 11/1967 | Simmons | 102/357 |
| 4,294,172 | 10/1981 | Rauschert et al. | 102/357 |
| 4,815,390 | 3/1989 | Garcia | 102/357 |
| 5,054,397 | 10/1991 | Hans et al. | 102/340 |

*Primary Examiner*—Harold J. Tudor

[57] ABSTRACT

A soft-recovery projectile having an aft portion, a forward portion and a gas seal mounted between the portions. The aft portion includes a recoverable payload such as projectile components or the like. The forward portion includes a parachute that is attached to the payload and is stored in a housing which is separably attached to the payload. The housing includes an explosive charge which is slectively triggered to cause separation of the housing from the payload and deployment of the parachute. A fin assembly, mounted on the housing, exerts a destablizing moment on the projectile when it is oriented with the fin assembly directed into the flight path. The projectile is launched with the fin assembly as the nose and the payload as the tail. After launch, the destabilizing moment will reorient the projectile into a position where the payload is the nose and the fin assembly is the tail. In this position, the fin assembly exerts a stabilizing moment on the projectile. At this point, the parachute is deployed by triggering the charge and thereby separating the housing and fin assembly from the payload.

5 Claims, 2 Drawing Sheets

SOFT-RECOVERY SYSTEM FOR GUN-LAUNCHED PROJECTILES

The invention described herein may be manufactured, used and licensed by or for the Government for governmental purposes without the payment to us of any royalties thereon.

BACKGROUND OF THE INVENTION

1. Field of the Invention

The present invention relates to the field of ordnance and, more particularly, to a ballistic projectile having a soft-recovery system.

2. Description of the Prior Art

During ballistic tests, it is often desired to recover fired projectiles or projectile components after they have been exposed to the temperatures, pressures and accelerations of a gun-launch environment. To be effective, the recovery process should not inflict any damage on the projectile which would mask the effects of the gun-launch environment. Typical components which often require recovery are rocket motors, fin assemblies and electronic components.

Currently, no acceptable method or apparatus is available to recover, undamaged, a component or components on the aft end of a statically stabilized projectile after being exposed to a gun-launch environment. In some prior art recovery methods, it is the general practice to fire projectiles into a soft medium such as sand. This method is not completely satisfactory because it does not ensure that the projectile will not sustain damage during impact with the soft medium. After recovery of such projectiles, it can be difficult to discern whether certain damage was due to being exposed to the gun-launch environment or due to the impact.

Another prior art recovery system uses a rearward deployed parachute recovery system. This configuration is unsatisfactory in situations where the component to be recovered is on the aft end of the projectile, i.e. that portion of the projectile behind the gas seal. If the components on the aft portion of the projectile are to be recovered, it is usually impossible to make alterations to the aft portion to accommodate the recovery hardware, i.e. the parachute recovery system. In such cases, the only available volume for locating the recovery hardware is at the forward end of the projectile (that portion in front of the gas seal). Design of a successful soft-recovery system for such a projectile is difficult because a parachute or other decelerator can not operate reliably when deployed into the flight path.

Although there has been a long recognized need for simple soft-recovery systems and methods for use in recovering components on the aft end of a projectile, no practical system or method has yet been devised. The present invention fulfills this need.

SUMMARY OF THE INVENTION

The general purpose of this invention is to provide a soft-recovery system that is mounted on the forward end of the projectile, leaving the aft end undisturbed. During recovery, the projectile experiences an extremely low-impact velocity.

The system has a rearwardly deployed payload that includes projectile components or the like to be recovered. A decelerator, connected to the payload, has a stored position and a deployed position. The decelerator, when in the deployed position, slows the speed of the payload. A gas seal, located between the payload and the decelerator, is capable of forming a seal between the projectile and the inside surface of a gun barrel to permit firing the projectile from the barrel with the payload in the tail position and with the decelerator in the nose position. A stabilizer, connected to the payload, causes the projectile, when it is in free flight in the atmosphere, to rotate into a stable position with the payload in the nose position and the decelerator in the tail position.

More specifically, the present invention is a soft-recovery projectile having an aft portion, a forward portion and a gas seal mounted between these portions. The aft portion includes the recoverable payload. The forward portion includes a parachute that is attached to the payload and is stored in a housing which is separably attached to the payload. The housing includes an explosive charge which is selectively triggered to cause separation of the housing from the payload and deployment of the parachute. A fin assembly, mounted on the housing, exerts a destablizing moment on the projectile when it is oriented with the fin assembly directed into the flight path. The projectile is launched with the fin assembly as the nose and the payload as the tail. After launch, the destabilizing moment, exerted by the fin assembly, will reorient the projectile into a position where the payload is the nose and the fin assembly is the tail. In this position, the fin assembly exerts a stabilizing moment on the projectile. At this point, the parachute is deployed by triggering the charge and thereby separating the housing and fin assembly from the payload.

The exact nature of this invention as well as other objects and advantages thereof will be readily apparent from consideration of the following specification relating to the annexed drawings.

DETAILED DESCRIPTION OF THE PREFERRED EMBODIMENT

Figure 1:
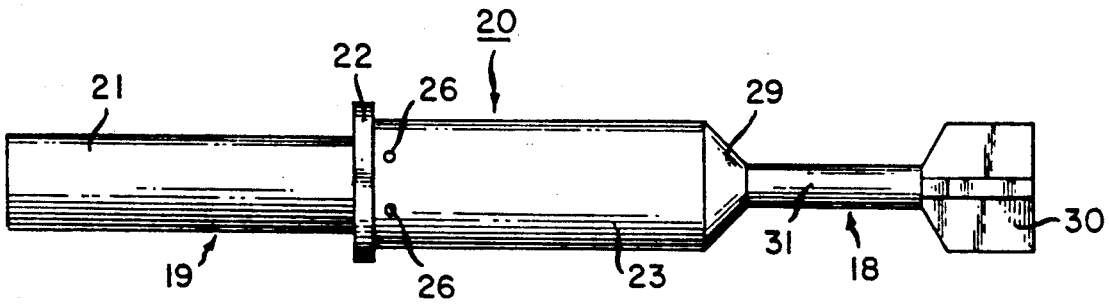
FIG. 1 is an elevation view of a preferred embodiment.
Figure 2:
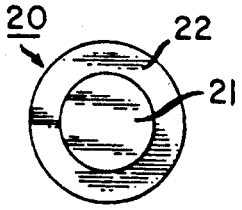
FIG. 2 is an end view as seen from the left side of the device shown in FIG. 1.
Figure 3:
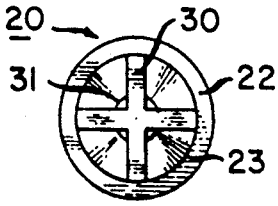
FIG. 3 is an end view, similar to FIG. 2, as seen from the right of the device shown in FIG. 1.

Referring now to the drawings, there is shown a projectile 20 having an aft portion 19 which includes a housing 21 in which the projectile components to be recovered are located. A gas seal 22, mounted at one end of the housing 21, defines the boundary between the aft portion 19 and the forward portion 18 of projectile 20. Gas seal 22 is designed in a conventional manner to form a tight seal with the inside surface of the gun bore 38 (FIG. 5) during firing. A base 24 (FIG. 4), fixed to the housing 21, extends beyond seal 22 into the forward portion 18. A second housing 23 is secured to the periphery of base 24. Base 24 has a plurality of openings 25 (FIG. 4) which receive shear pins 26 that pass through the periphery of housing 23.

A soft-recovery system, mounted in housing 23, includes a decelerator in the form of a folded parachute 27 that is located inside a protective shroud 28. A conventional parachute expulsion system 29 is mounted inside the forward cone-shaped section of housing 23. The parachute 27 is joined at one end to the base 24. A fin assembly 30 is mounted at the most forward end of the projectile 20 by a boom 31 which is carried by the housing 23.

Figure 5A:
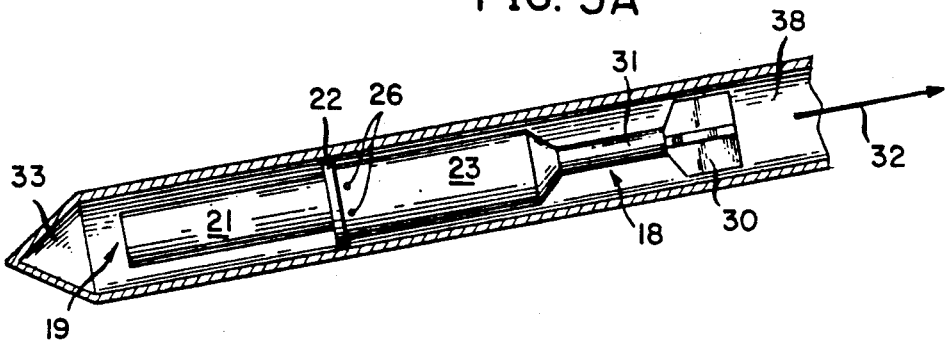
FIG. 5A is an elevation view showing the invention in combination with a launcher that is shown in section to illustrate the invention in a first operating position.
Figure 5B:
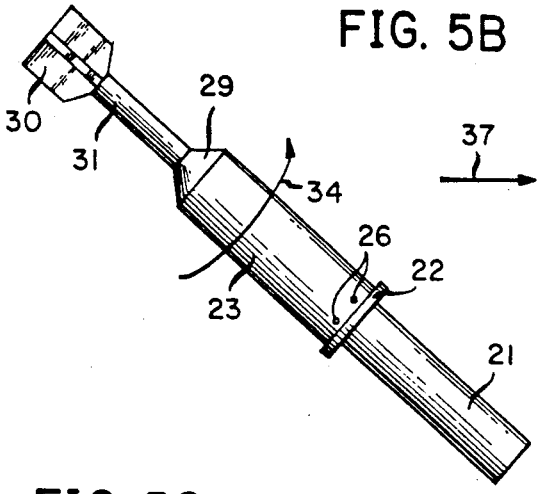
FIG. 5B is an elevation view of the invention as it would appear in a second operating position shortly after leaving the position shown in FIG. 5A.

FIGS. 5A-5B depict a typical operation of the projectile 20 during launch and recovery. The projectile 20 is placed in the gun bore 38 with the aft section 19 in the tail position and located in the breech 33, and with the fin assembly 30 in the most forward nose position and pointed toward to barrel opening. Upon firing, the expanding gases in the breech 33, caused by a conventional explosive charge (not shown), will exert pressure on the housing 21 and the seal 22 (FIG. 5A), thereby causing the projectile 20 to accelerate and travel at a high rate of speed along the bore 38 in the direction of the arrow 32 (FIG. 5A), i.e. with the fin assembly 30 leading and the housing 21 trailing.

Figure 5C:
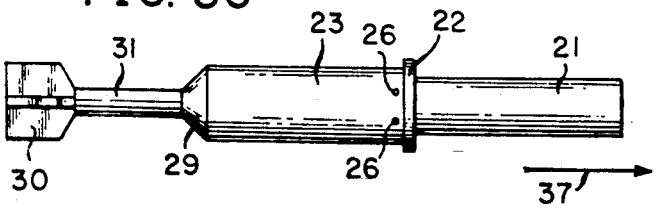
FIG. 5C is an elevation view of the invention as it would appear in a third operating position shortly after leaving the position shown in FIG. 5B.
Figure 5D:
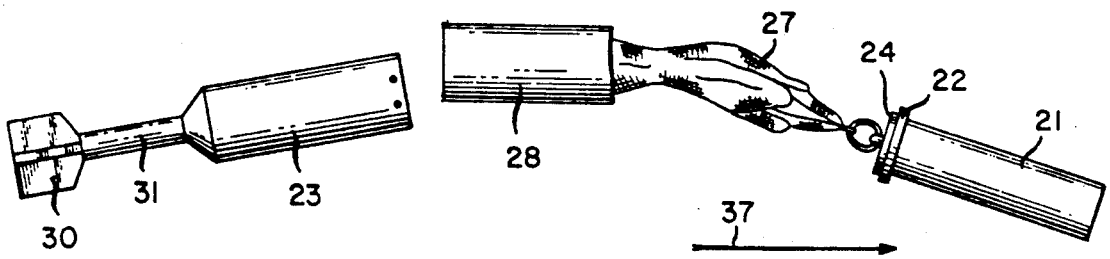
FIG. 5D is an elevation view of the invention as it would appear in a fourth operating position shortly after leaving the position shown in FIG. 5C and just after employing the decelerator apparatus.

Upon leaving the bore 38, the launched projectile 20 (FIGS. 5B-5D) will be in free flight in the atmosphere traveling in the general direction indicated by the arrows 37. As such, it will be subject to the usual forces caused by air streams passing over its surfaces. Because the projectile 20 is initially oriented with the fin assembly 30 in the nose position, the launched projectile 20 will at first be statically highly unstable. Consequently, just after launch the projectile 20 will rapidly turn over, as indicated by arrow 34 in FIG. 5B, and quickly stabilize with the fin assembly 30 oriented rearward in the tail position and the housing 21 in the nose position (FIG. 5C).

Figure 4:
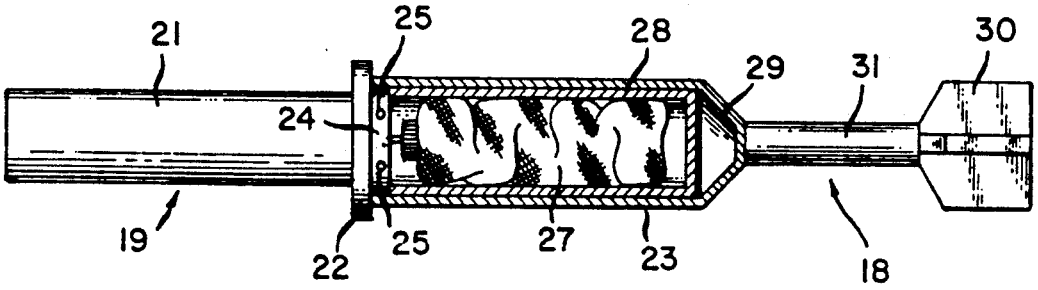
FIG. 4 is a view similar to FIG. 1 showing the preferred embodiment with parts cut away to expose interior portions of the projectile.

With the projectile 20 in this orientation, the parachute 27 can be deployed away from the flight path (FIG. 5D) by the parachute expulsion system 29 (FIG. 4). The parachute expulsion system 29 may include a conventional explosive charge with appropriate time delay or remote triggering systems that will ignite the explosive charge inside the cone-shaped forward section of the housing 23 to raise the internal pressure a sufficent amount to shear the pins 26. When the pins 26 shear, the housing 23 will seperate from the base 24. This action will permit the parachute 27 to be deployed while its protective shroud 28 seperates therefrom due to drag from the atmosphere. When fully deployed, the parachute 27 will decelerate the housing 21, causing it to slow down and descend at a low enough speed such that no damage is caused on impact which would obscure the effects of the gun-launch environment on the projectile components housed therein.

Obviously, many modifications and variations of the present invention are possible in the light of the above teachings. For example, the static instability of the projectile 20 at launch, its static stability in the parachute-launching orientation, and the pitch damping during reorientation can all be greatly increased by lengthening the boom 31 and increasing the chord of the fin assembly 30. By making the fin assembly 30 sufficiently large and placing it a sufficent distance from the center of gravity of the projectile 20, rapid turn-over can be achieved to produce quick reorientation. Also, structures other than the boom-fin assembly shown in the preferred embodiment may be used to provide the required destablizing moment at launch and the required stablizing moment after reorientation. For example, a flare may be readily substituted for the fin assembly 30 and boom 31 by those skilled in these arts.

It is also noted that the invention is equally applicable to smooth-bore guns, rifle-bore applications and other launch systems. Clearly, those skilled in these arts will find the present invention applicable to other situations where a gun-launched payload must be delivered by a soft-recovery device, such as a parachute or other decelerator, and the soft-recovery device must be packaged in front of the payload when the projectile is in the gun.

The foregoing disclosure and drawings are merely illustrative of the principles of this invention and are not to be interpreted in a limiting sense. It is to be understood that the invention should not be limited to the exact details of construction shown and described because obvious modifications will occur to a person skilled in the art.

What is claimed is:

1. A soft-recovery projectile system comprising:

a payload comprising an aft end of an in-flight statically-stabilized projectile, including electronic projectile components to be recovered;

a decelerator means comprising a parachute connected to said payload, having a stored position and a deployed position, for slowing the velocity of said payload when said decelerator means is in said deployed position;

a gas seal means located between said payload and said decelerator means forming a seal between said projectile and the inside surface of a gun barrel to permit firing said projectile from said barrel with said payload in a tail position and with said decelerator in a nose position; and stabilizing means connected to said payload for causing said projectile, when in free flight in the atmosphere, to turn into a stable position with said payload in the nose position and said decelerator in the tail position, wherein said stabilizing means includes a fin assembly means for exerting a destabilizing moment on said projectile when said projectile is moving in the atmosphere with said electronic payload in the tail position and wherein said fin assembly means includes an elongated cylindrical boom having fins at its distal end.

2. The projectile of claim 1 further including a parachute deployment means for maintaining said parachute in said stored position and for selectively deploying said parachute into said deployed position.

3. The projectile of claim 2 wherein said parachute deployment means includes a housing having one end releasably connected to said payload, said parachute contained in said housing when in said stored position.

4. The projectile of claim 3 wherein said parachute deployment means includes a parachute expulsion means for selectively disconnecting said housing from said payload whereby said parachute is deployed into said deployed position.

5. The projectile of claim 4 wherein said stabilizing means is mounted on said housing.

* * * * *